US006344136B1

(12) United States Patent
Butler et al.

(10) Patent No.: US 6,344,136 B1
(45) Date of Patent: Feb. 5, 2002

(54) METHODS FOR REDUCING SULFUR AND CARBON IN PETROLEUM REFINING PROCESSES

(75) Inventors: James R. Butler, Houston; Mark Kuchenmeister, Friendswood, both of TX (US)

(73) Assignee: Fina Technology, Inc., Houston, TX (US)

( * ) Notice: Subject to any disclaimer, the term of this patent is extended or adjusted under 35 U.S.C. 154(b) by 0 days.

(21) Appl. No.: 09/262,162

(22) Filed: Mar. 3, 1999

(51) Int. Cl.[7] ..... C10G 45/04

(52) U.S. Cl. ..... 208/217; 208/210; 208/220; 208/221

(58) Field of Search ..... 208/217

(56) References Cited

U.S. PATENT DOCUMENTS

| | | | | | |
|---|---|---|---|---|---|
| 4,786,404 | A | * | 11/1988 | Kemp | 208/217 |
| 5,001,101 | A | * | 3/1991 | Kemp | 208/217 |
| 5,006,224 | A | * | 4/1991 | Smegal et al. | 208/217 |
| 5,198,100 | A | * | 3/1993 | Aldridge et al. | 208/217 |
| 5,266,188 | A | * | 11/1993 | Kukes et al. | 208/217 |
| 5,290,429 | A | * | 3/1994 | Delaney et al. | 208/217 |

* cited by examiner

*Primary Examiner*—Helane E. Myers
(74) *Attorney, Agent, or Firm*—William D. Jackson

(57) ABSTRACT

A process is disclosed for the hydrotreatment of feedstocks for fluidic cat crackers comprising reacting such feedstocks over high-conversion catalyst contain grate nickel-tungsten.

6 Claims, 1 Drawing Sheet

METHODS FOR REDUCING SULFUR AND CARBON IN PETROLEUM REFINING PROCESSES

FIELD OF THE INVENTION

The present invention relates to petroleum refining processes and more particularly involves hydrotreating methods for removal of unwanted sulfur and carbon during the refining of crude oil into gasoline and other hydrocarbon products.

BACKGROUND OF THE INVENTION

The present invention involves the treatment of feedstocks for supplying fluid catalytic cracking (FCC) reactors. Fluid catalytic cracking is a process for converting high molecular weight hydrocarbons into the more valuable, lighter, low-molecular-weight products by contacting the high molecular weight hydrocarbons with a powdered catalyst under appropriate process conditions. The typical cat cracker process is used to convert excess refinery gas oils and heavier refinery streams into gasoline, $C_3$ and $C_4$ olefins, and light cycle oil. The FCC process in intended to bring refinery output into line with the product market demands. The FCC process is usually the heart of a modern petroleum refinery because of its adaptability to changing feedstocks and product demands and because of the high margins that exist between FCC feedstocks and FCC products. As oil refining has evolved over the last fifty years, the FCC process has evolved with it by allowing the cracking of heavier, more contaminated feedstocks, thereby increasing the operating flexibility of the modern refinery while accommodating environmental legislation and further maximizing reliability.

The modern FCC unit accepts a large and broad range of feedstocks which contributes

SUMMARY OF THE INVENTION

Traditional wisdom in the refining industry has indicated that the use of tungsten as a hydrotreater catalyst would be unsuccessful due to the fact that tungsten is too sensitive to sulfur, although tungsten is more active in hydrogenation than conventional materials such as nickel, moly, and cobalt/moly. However, the present inventors have discovered that a nickel-tungsten catalyst (NiW) can be used with a high-sulfur feedstock to increase the production of feedstock material for conventional FCC reactors. By utilizing tungsten instead of molybdenum or cobalt, the refiner can increase the conversion rate in the hydrotreater significantly with only a minimal increase in material cost for the new catalyst. Although the tungsten-on-alumina catalyst has been utilized in hyrdocracking, it has never been believed possible to utilize a nickel-tungsten catalyst for hydrotreating. The present inventors have discovered the process for increased conversion whereby nickel-tungsten may be used for hydrotreating feedstocks for FCC reactors to remove excess carbon and sulfur.

BRIEF DESCRIPTION OF THE DRAWING

The FIGURE is a schematic representation of a typical hydrodesulfurization/hydrotreater system utilized with a commercial FCC reactor unit for the removal of metals, sulfur, and ConCarbon from the catcracker feedstock.

DESCRIPTION OF THE PREFERRED EMBODIMENTS

Figure 1:
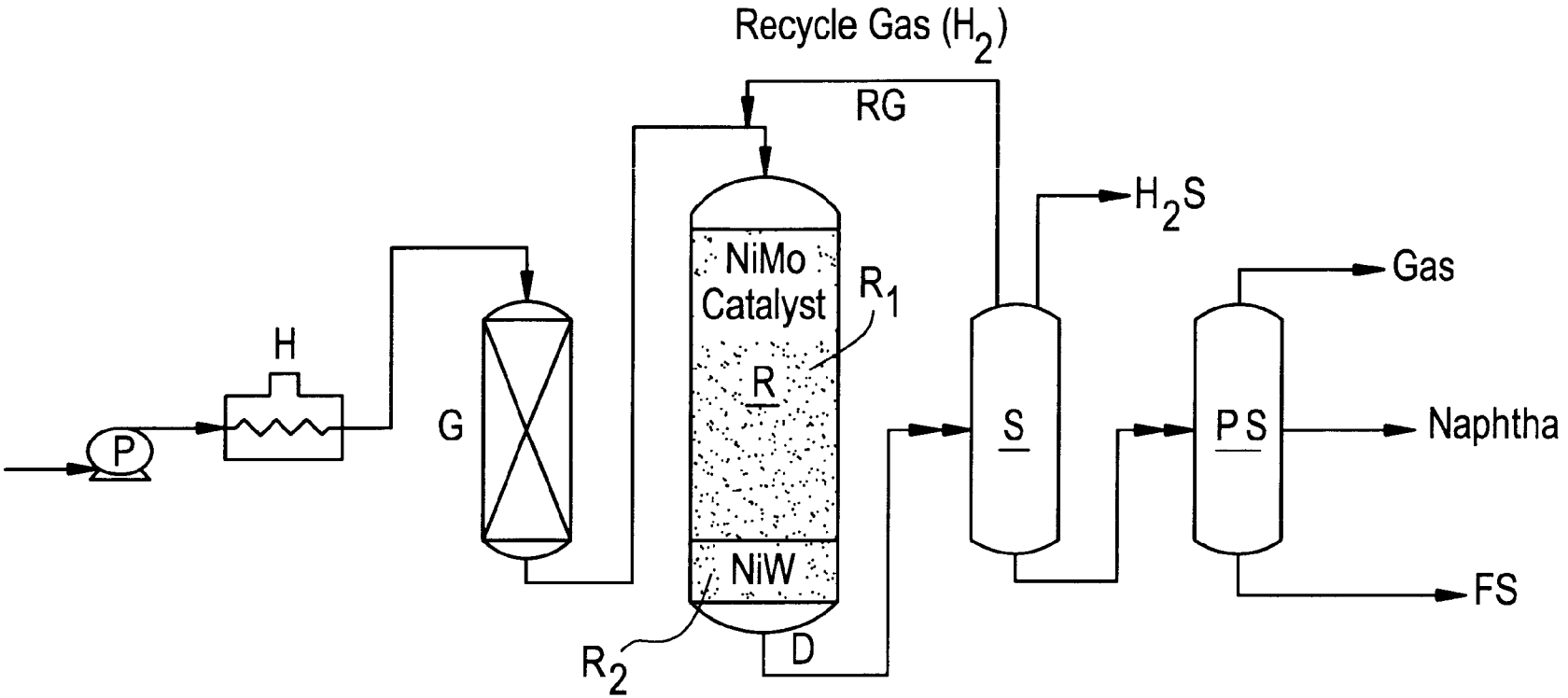

Referring now to the drawing which illustrates the schematic diagram of a typical hydrotreating system for desulfurizing and purifying a catcracker feedstock, the FIGURE illustrates an oil feed line which is connected to a pump P for pumping feedstock through a heater H into a greatly to the reputation and success of catalytic cracking as one of the most flexible refining processes available. Some common feedstocks utilized in a conventional distillate-feed FCC unit are atmospheric gas oils, vacuum gas oils, coker gas oils, thermally-cracked gas oils, solvent-deasphalted oils, lube extracts, and hydrocracker bottoms.

Residual oil FCC units (RFCC) charge Conradson Carbon (ConCarbon) residue and metal-contaminated feedstocks, such as atmospheric residues or mixtures of vacuum residue and gas oils. These feedstocks normally must be hydrotreated or deasphalted before being fed into an RFCC unit. Feed-hydrotreating reduces the carbon residue and metal content of the feedstock thereby reducing the coke-making tendency of the feed and preventing catalyst deactivation.

Some products derived from the FCC and RFCC processes typically involve fuel gas, such as ethane and lighter hydrocarbons, hydrogen sulfide, $C_3$ and $C_4$ liquefied petroleum gasses (LPG), gasoline, light cycle oil, slurry oil, and coke. Although gasoline is typically the most desirable product from such a process, the design and operating variables can be adjusted to maximize other products for three principle modes of FCC operation, which are:

a) maximum gasoline production;

b) maximum light cycle oil production; and, c) maximum light olefm production.

In the second of the aforementioned FCC maximization configurations, i.e. (b) maximum middle distillate production, the preparation of the feedstock for such an operation is critical. Refiners use hydrotreating processes to produce low sulfur fuel oils and also to prepare feedstock for fluid catalytic crackers and residual fluid catalytic crackers for producing middle distillate products such as fuel oil and diesel oil. In the 1950's and 60's when it became apparent that the sulfur content of our liquid fuels such as fuel oil, diesel oil and gasoline, was damaging our environment, including the quality of air we breath and flora and fauna of our environment, refiners began searching for methods of removing such harmful substances from our liquid fuels.

Original attempts utilized flue gas scrubbers to remove sulfur from the generation plants and other systems utilizing the liquid fuel oils and diesels for generating electric power. While this system sufficed to remove sulfur from such systems, it was an expensive and complicated process and still failed to answer the question of removing exhaust sulfur from automobiles and trucks which burn diesel fuel and gasoline. An alternative method of sulfur removal was needed. This resulted in the development of hydrotreating units for the removal of harmful contaminants such as metals, excess carbon and sulfur. Such units must be capable of removing such contaminants in a wide variety of fuels and hydrocarbon systems. Two different applications of hydrotreating have developed, which are closely related. One is a system for removal of contaminants from fuel oils in the manufacturing process for medium distillates. The other is in the removal of sulfur from the feedstock for FCC and RFCC units.

Hydrotreaters can also upgrade residual oils by removing impurities and cracking heavy molecules in the feedstock to produce more desirable lighter product oils. The first such use of hydroprocessing technology was initially to remove sulfur from atmospheric residues and vacuum residues. The term "desulfurization" originated with this usage. Commercial hydrotreaters today are capable of removing nitrogen, ConCarbon residue, nickel, vanadium, and sulfur while also cracking heavy vacuum resid feedstock to vacuum gas oil, distillates, and naphtha products. Sulfur removal greater than ninety-five percent can be achieved with modern hydrotreaters.

The typical commercial hydrotreater uses multiple fixed beds of catalyst which typically operate at moderately high pressures in the range of 150–250 atmospheres and temperatures in the range of 350–425° C. in the hydrogen-rich atmosphere (80–95 mol percent hydrogen at the the guard reactor G which is basically a conventional demetallization reactor.

EXAMPLE OF THE PREFERRED EMBODIMENT

In experimental runs in a pilot plant, a desulfurinzing reactor was loaded with NiW catalyst, and the catalyst dried using conventional drying techniques. The feedstock supplied to the reactor initially consisted of straight-run diesel which was reacted in the reactor over the NiW catalyst for 24 hours. The feedstock was then switched to gas oil and run for four days. The conditions were completed for kinetic calculations and the reactor temperature brought to 685 degrees F to obtain baseline activity data. After obtaining run results at the baseline conditions, the temperature was then increased to 720 degrees F to measure the long term stability of the catalyst for comparison to that of conventional catalysts.

The hydrodesulfurization (HDS) activity was measured and compared to a desired target level. The activity exceeded the desired 70%. At the higher temperature, the activity reached and was maintained at a conversion level of 85%, which was a full 15% higher than the desired level. At the lowest temperature, the conversion was in the range of 40–50%, a full 10% higher than expected. The advantage of such conversion rate increase is that it allows the operator the option of either lowering the reactor temperature to achieve longer catalyst life, or operating at conventional temperatures and obtaining higher conversion rates, and consequently, higher profitability in the refinery FCCU.

In addition, at the higher reactor temperature of 720 degrees F, it was noted that the conversion rate was maintainable at around 85% without any significant deactivation of the catalyst. The conclusion was that the present invention offered significant improvement in conversion rates over conventional catalyst systems without noticeable degradation of catalyst guard reactor G. The guard reactor G is a conventional demetallizing reactor for removing metallic contaminants from the feedstock. The feedstock passes through guard reactor G and is charged into the main reactor R, which contains a dual catalyst system. The upper majority portion of the catalyst bed in reactor R, as indicated at R1, comprises a conventional nickel molybdenum desulfurizing catalyst. The lower portion, R2, of the catalyst bed in reactor R comprises a minor portion of the catalyst and consists of the unconventional nickel-tungsten (NiW) hydrocracking catalyst. In one embodiment of the invention, about eighty percent (80%) of the catalyst was contained in section R1 and consisted of nickel/moly catalyst, while the remaining approximately twenty percent (20%) consisted of the nickel-tungsten catalyist in R2. A discharge line D at the bottom of main reactor R takes the treated feedstock into a separator system S which separates gaseous products from liquid products. The gasses are then further separated into hydrogen which is recycled through recycle gas line RG and, with fresh hydrogen (not shown), is introduced into the main reactor R; and hydrogen sulfide ($H_2S$) which is removed for disposal. The liquid output of the separator system S passes into the product stripper system (PS) represented schematically as a single vessel, but in truth actually representing multiple vessels which together make up a stripper system. The product stripper system (PS) separates gas, naphtha and FCC feedstock, which three products pass through the three designated lines.

The hydrodesulfurizer reactor R as indicated in the figure utilizes a majority catalyst section R1, of conventional desulfurizing catalyst such as nickel molybdenum in the upstream portion of the reactor. In the downstream end of the reactor a minor portion of the conventional catalyst has been replaced by the unexpectedly productive nickel-tungsten designated at R2. The results of this unexpected catalyst combination is that the sulfur-sensitive tungsten catalyst is protected from contamination by the normal desulfurization catalyst NiMo in section R1. The presence of the nickel-tungsten catalyst in R2 provides increased hydrogen for reduction of aromatics and for reduction of carbon laydown (coke). Because the tungsten has a higher hydrogenation ability than molybdenum, the presence of the nickel-tungsten catalyst in R2 increases the productivity and efficiency of the HDS reactor R significantly. Although the nickel-tungsten catalyst is more expensive than both nickel-moly catalyst and cobalt-moly catalyst, the price difference is offset manyfold by the increased conversion rates obtained with this unexpected catalyst combination. The presence of the nickel-tungsten catalyst allows the better optimization and utilization of available hydrogen in the lower part of the HDS reactor R2. By the time the feedstock has reached this portion of the reactor, the hydrogen has been pretty much depleted and is relatively scarce. Due to the better hydrogenation ability of tungsten, the scarce supply of hydrogen in reactor section R2 is utilized to a much greater level.

The catalyst utilized in R2 may be manufactured by taking a conventional catalyst such as the AKZO 841 commercially available catalyst, which is a nickel-moly catalyst, and replacing the molybdenum with tungsten. As a result, a higher conversion rate to FCC feedstock is obtained in reactor R plus the reactor can be run at a lower inlet temperature to provide further energy savings. The better utilization of hydrogen in the lower or downstream end of the reactor by the tungsten-catalyst increases the available hydrogen to reduce undesirable aromatics and to further reduce carbon laydown. It is important to note that the reduction of carbon allows the catcracker to operate at higher limits because the physical limits on the catcracker production are the wet gas compressors and the air blowers. The production can be increased through the catcracker by alleviating pressure on these two elements by reducing their carbon load. By removing carbon, the catcracker can run at higher conversion rates when using gas oil to manufacture diesel. Other contaminants such as nickel and vanadium, generally found in most crude oils, are removed in reactor inlet) to process the oil feedstock. The normal feedstock to a hydrotreater may generally comprise the vacuum resid from a crude unit vacuum column with a typical boiling point (TBP) cut point of around 538° C., although higher cut points are feasible. On the other hand, hydrotreaters utilizing atmospheric resid from a crude unit atmospheric column have a typical starting TBP cut point of around 370° C. Other feedstocks such as solvents, deasphalted oil, deasphalted pitch, vacuum gas oil, and cracked gas oils can also be processed in either residual desulfurizers or vacuum residual desulfurizers. Typical hydrotreater catalysts generally include cobalt, nickel, molybdenum (moly), and other materials. Catalyst pellets are usually small, ranging from 0.8 to about 1.3 mm in diameter, with a high surface-to-volume ratio leading to better reactivity. The pellets are generally small extruded catalyst material put on an alumina base. Different shapes of extruded pellets are used to take advantage of the high surface-to-volume ratios of some geometric shapes, while maintaining reasonable reactor pressure drop.

Refiners are continuously searching for catalyst materials which provide better sulfur removal and require less maintenance and regeneration. More particularly, refiners are looking to replace the metal catalyst on the alumina base with some element having better hydrogenation ability, good economics, and better resistance to coking. In addition, the search for better catalysts involves the attempt to improve the FCC reactor production which appears to be primarily limited by the capacities of the wet gas compressors and air blowers. Refiners have found that alleviating pressures on these components by reducing the carbon loading on the catalyst also reduces the regeneration load. Removing carbon from the catalyst allows the running of higher conversion rates when the FCC unit is using gas oil to manufacture diesel oil life.

Thus the present invention has been described and illustrated in the description above and the accompanying drawing, as providing a unique combination of catalyst for a hydrodesulfurization (HDS) reactor for manufacturing feedstocks for a fluid catalytic converter.

What is claimed is:

1. A process for the hydrotreating of a feedstock to be supplied to a catalytic cracker comprising:

(a) supplying a sulfir containing hydrocarbon stream and hydrogen to a multi-stage hydrotreating reactor;

(b) within said reactor passing said feedstock into contact with an initial catalyst stage comprising a desulfurization catalyst selected from the group consisting of a nickel molybdenum catalyst and a cobalt molybdenum catalyst;

(c) thereafter supplying said hydrocarbon stream through a subsequent catalyst stage comprising a nickel-tungsten hydrocracking catalyst; and (d) withdrawing an effluent stream from said hydrotreating reactor for use as a feedstock of a catalytic cracker.

2. The process of claim 1 wherein the initial catalyst stage of said desulfurization catalyst comprises a major portion of the catalyst within said hydrotreating reactor and the subsequent catalyst stage of said nickel-tungsten catalyst comprises a minor portion of the catalyst in said hydrotreating reactor.

3. The method of claim 2 wherein said initial catalyst stage provides about 80% of the catalyst contained in said hydrotreating reactor and the nickel-tungsten catalyst in said subsequent catalyst stage provides about 20% of the catalyst in said hydrotreating reactor.

4. The process of claim 1 wherein said initial catalyst stage contains a nickel-molybdenum catalyst.

5. The process of claim 4 wherein initial catalyst stage of said nickel-molybdenum desulfurization catalyst comprises a major portion of the catalyst within said hydrotreating reactor and the subsequent catalyst stage of said nickel-tungsten catalyst comprises a minor portion of the catalyst in said hydrotreating reactor.

6. The method of claim 5 wherein the initial nickel-molybdenum catalyst provides about 80% of the catalyst contained in said hydrotreating reactor and the nickel-tungsten catalyst and said subsequent catalyst stage provides contains about 80% of the catalyst in said hydrotreating reactor.

* * * * *